US005672960A

United States Patent [19]

Manaresi et al.

[11] Patent Number: 5,672,960

[45] Date of Patent: Sep. 30, 1997

[54] THRESHOLD EXTRACTING METHOD AND CIRCUIT USING THE SAME

[75] Inventors: Nicolò Manaresi; Antonio Gnudi, both of Bologna; Dario Bruno, Palermo; Biagio Giacalone, Trapani, all of Italy

[73] Assignee: Consorzio per la Ricerca sulla Microelettronica nel Mezzogiorno, Catania, Italy

[21] Appl. No.: 575,690

[22] Filed: Dec. 19, 1995

[30] Foreign Application Priority Data

Dec. 30, 1994 [EP] European Pat. Off. ..... 94830595

[51] Int. Cl.[6] ..... G05F 3/16

[52] U.S. Cl. ..... 323/313; 323/315

[58] Field of Search ..... 323/312, 313, 323/315, 314, 316; 327/530, 538

[56] References Cited

U.S. PATENT DOCUMENTS

| | | | |
|---|---|---|---|
| 3,823,332 | 7/1974 | Ferszka et al. | 307/297 |
| 4,831,323 | 5/1989 | Melbert | 323/311 |
| 5,175,489 | 12/1992 | Mizuide | 323/315 |
| 5,311,115 | 5/1994 | Archer | 323/315 |
| 5,349,286 | 9/1994 | Marshall et al. | 323/315 |
| 5,483,196 | 1/1996 | Ramet | 330/257 |

FOREIGN PATENT DOCUMENTS

| | | | |
|---|---|---|---|
| 0 397 408 | 11/1990 | European Pat. Off. | G05F 3/24 |
| 0 610 064 | 8/1994 | European Pat. Off. | H03K 17/16 |
| 2 071 955 | 9/1981 | United Kingdom | G05F 1/56 |

OTHER PUBLICATIONS

IEEE Journal Of Solid–State Circuits, vol. 23, No. 3, Jun. 1988 New York, US, pp. 821–824, Sansen, et al. "A CMOS Temperature–Compensated Current Reference".

IEEE Journal Of Solid–State Circuits, vol. 27, No. 9, Sep. 1992, pp. 1277–1285, Zhenhua Wang "Automatic Vt Extractors, based on a . . . and their Application".

IEE Proceedings G Electronic Circuits & Systems, vol. 3, No. 1, 1979 Stevenage GB, pp. 1–4, Y:P: Tsividis, et al, "Threshold Voltage Generation and Supply Independent Biasing In C.M.O.S. Integrated Circuits".

*Primary Examiner*—Adolf Berhane

*Attorney, Agent, or Firm*—Wolf, Greenfield & Sacks, P.C.; James H. Morris; Brett N. Dorny

[57] ABSTRACT

A transistor threshold extraction circuit including at least two transistors of the same type each having a control terminal and having essentially a same threshold voltage, each of the two transistors also having first and second main conduction terminals, a current mirror circuit having at least two input-output terminals with the two terminals coupled respectively to the two transistors so as to supply bias currents, a voltage generator connected between the two control terminals, and a feedback path between the control terminals and one of the input-output terminals. An output of the extraction circuit is coupled to one of the control terminals.

21 Claims, 3 Drawing Sheets

THRESHOLD EXTRACTING METHOD AND CIRCUIT USING THE SAME

BACKGROUND OF THE INVENTION

1. Field of the Invention

The present invention relates to a transistor threshold extraction method and to a transistor threshold extraction circuit.

2. Discussion of the Related Art

Threshold extraction finds various applications in the field of the characterization of electronic devices, level translation, absolute or relative temperature measurement, temperature compensation, and compensation of process parameters. A specific panorama of this subject is set forth in the article by Zhenhua Wang, "Automatic Vt Extractors . . . and Their Applications", in IEEE Journal of Solid-State Circuits, Vol. 27 No. 9 pages 1277–1285, September 1992.

This article discloses the circuit shown in FIG. 1. The circuit of FIG. 2 comprises two N-channel MOS transistors M1 and M2 having the same threshold voltage and a current mirror MC having an input terminal IM and an output terminal OM. The source terminals S1 and S2 of the transistors M1 and M2 are connected to a ground terminal GND, their drain terminals D1 and D2 are respectively connected to the terminals IM and OM, and their gate terminals G1 and G2 are respectively connected to the input IT and output OT. In addition the gate and drain terminals of the transistor M2 are connected together.

The potential at the output OT is given by a linear combination of the input potential IT and the threshold voltage of the transistors M1 and M2. This depends only on geometric parameters with the exception however of the potential at the input IT.

The Wang article discussed above proposes a variation of the circuit mentioned above in which by setting the ratio W/L of transistor M1 equal to one fourth of the ratio W/L of transistor M2 and connecting to the output of the above circuit of FIG. 1 an amplifier with a gain of two, there is achieved at the output a potential equal to the sum of the potential at the input IT and of the threshold voltage of the transistors M1 and M2.

The circuits described above have an advantage of extracting the threshold voltage of the transistors free from body effect since the source terminals of the N-channel transistors are connected to the substrate (in the case of N-well process) or to the process well (in the case of P-well process). Other circuits require separate wells in which to insert the transistors to be free of the body effect, or limit the of threshold extraction to transistors of a single polarity.

The purpose of the present invention is to supply an alternative circuit to that of the known art.

SUMMARY OF THE INVENTION

In embodiments of the present invention, a voltage generator is connected between the control terminals of two transistors and a feedback path is established between the control terminals and one of the input-output terminals of a current mirror circuit.

In addition, in embodiments of the present invention a circuit is provided having an output that achieves a potential equal to the sum of a threshold voltage of transistors of the circuit and a generator voltage multiplied by a constant which depends only on geometrical parameters.

The present invention also relates to a circuitry system using and comprising a circuit in accordance with the above described embodiments of the present invention for operating independently of temperature and dispersion.

DETAILED DESCRIPTION

Figure 2:
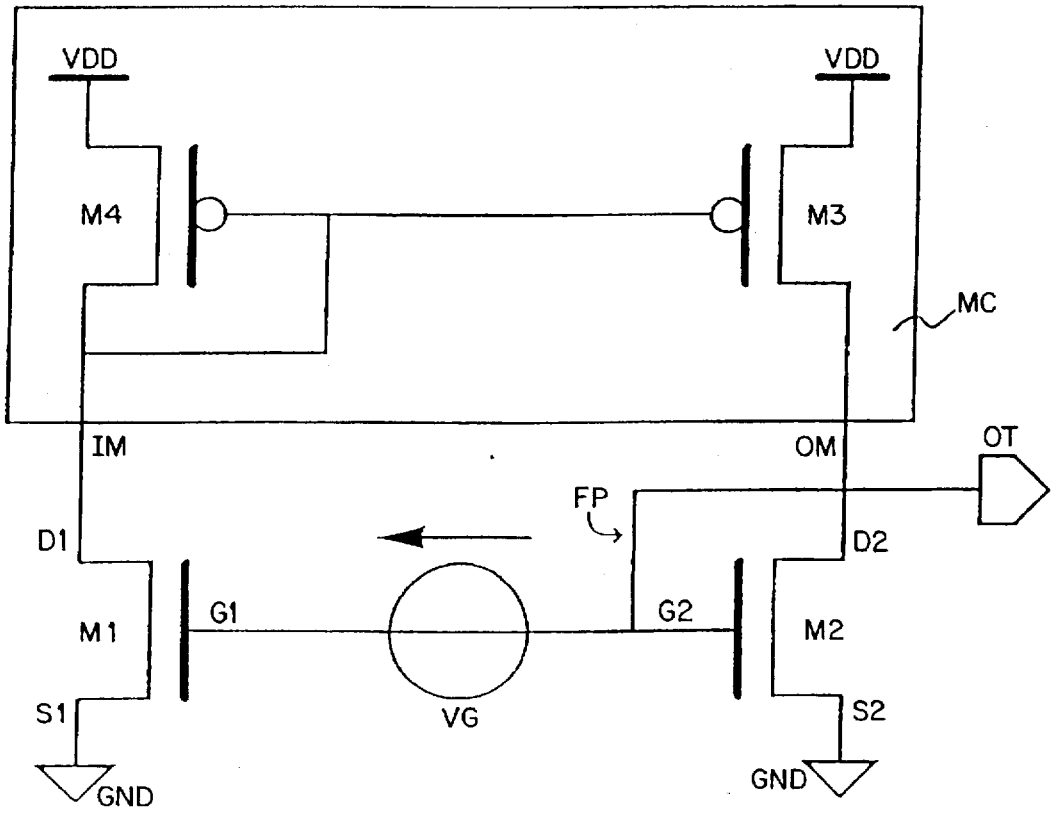
FIG. 2 shows a first circuit in accordance with one embodiment of the present invention.

The circuit of FIG. 2 comprises N-channel MOS transistors M1 and M2 having essentially the same threshold voltage and a current mirror MC having an input terminal IM and an output terminal OM. The circuit also has an output OT. Source terminals S1 and S2 of the transistors M1 and M2 are connected to a ground terminal GND while drain terminals D1 and D2 are connected respectively to the terminals IM and OM, and gate terminals G1 and G2 are connected respectively to positive and negative terminals of a voltage generator VG. In addition the gate and the drain terminals of transistor M2 are connected together by means of a feedback path FP consisting of a short circuit. The output OT is connected to the terminal G2.

In FIG. 2 a very simple implementation of the mirror MC is also shown. This consists of two P-channel MOS transistors M3 and M4 having source terminals connected to a supply terminal VDD, and gate terminals connected together. A drain terminal of transistor M3 is connected to the terminal OM of the mirror MC and a drain terminal and the gate terminal of the transistor M4 are connected together to the terminal IM.

A voltage potential at the output OT is given by the sum of the threshold voltage of the transistors M1 and M2 and of the voltage of the generator VG multiplied by a constant as follows:

$$\frac{\sqrt{A*K2/K1}}{1-\sqrt{A*K2/K1}}$$

where A is the current gain between input and output of the mirror MC, and K1 and K2 are the ratios W/L respectively of the transistors M1 and M2. This constant depends only on geometrical parameters and can thus be well controlled and made either very large or very small depending on requirements.

Preferably this circuit is sized in such a way that the MOS transistors are operated normally under saturation conditions. In a first approximation, the current of a MOS transistor in saturation does not depend on its voltage VDS, the voltage from drain to source of the transistor.

Figure 5:
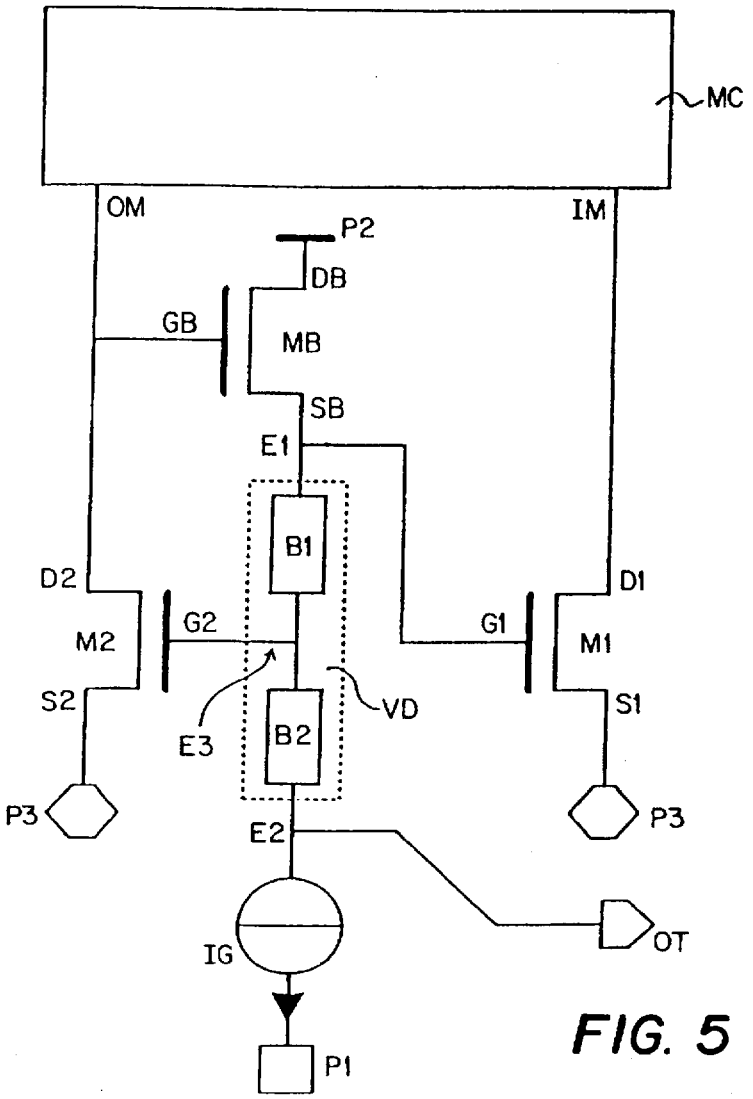
FIG. 5 shows a fourth circuit in accordance with another embodiment of the present invention.

An implementation of the generator VG that is a bit complicated, but has excellent performance in terms of independence from temperature and from process tolerances can be obtained by modifying the circuit illustrated in FIG. 5 of the article by Zhenua Wang "A CMOS . . . Analog Multiplier . . ." in IEEE Journal of Solid-State Circuits, Vol. 26 No. 9 pages 1293–1301, September 1991. If in this circuit the terminal VSS is connected to ground, one of the two identical output stages, generating a floating voltage VB is eliminated, the negative pole of the input VY is connected to ground and the positive pole is connected to a constant potential generator referred to ground, e.g., the "band gap" type, at the output of the circuit a constant voltage, VB is obtained not referred to ground, i.e., floating.

Figure 3:
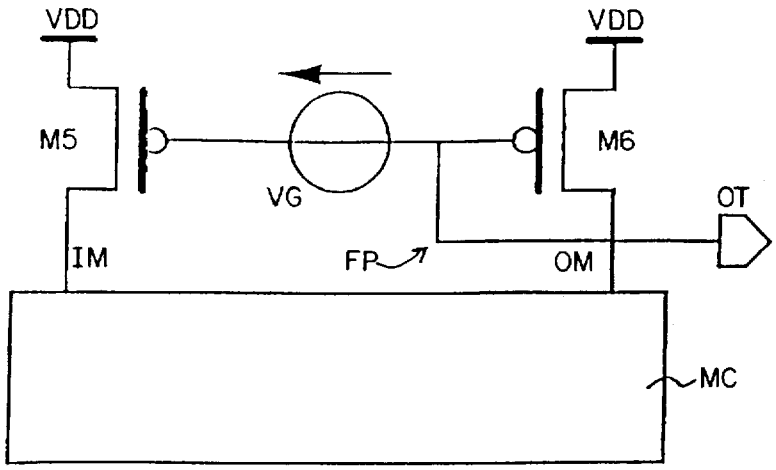
FIG. 3 shows a second circuit in accordance with another embodiment of the present invention.

FIG. 3 shows a circuit similar to that of FIG. 2 but based on two transistors M5 and M6, again of the MOS type but P channel. In this case the source terminals of the transistors are connected to a supply terminal VDD.

Figure 4:
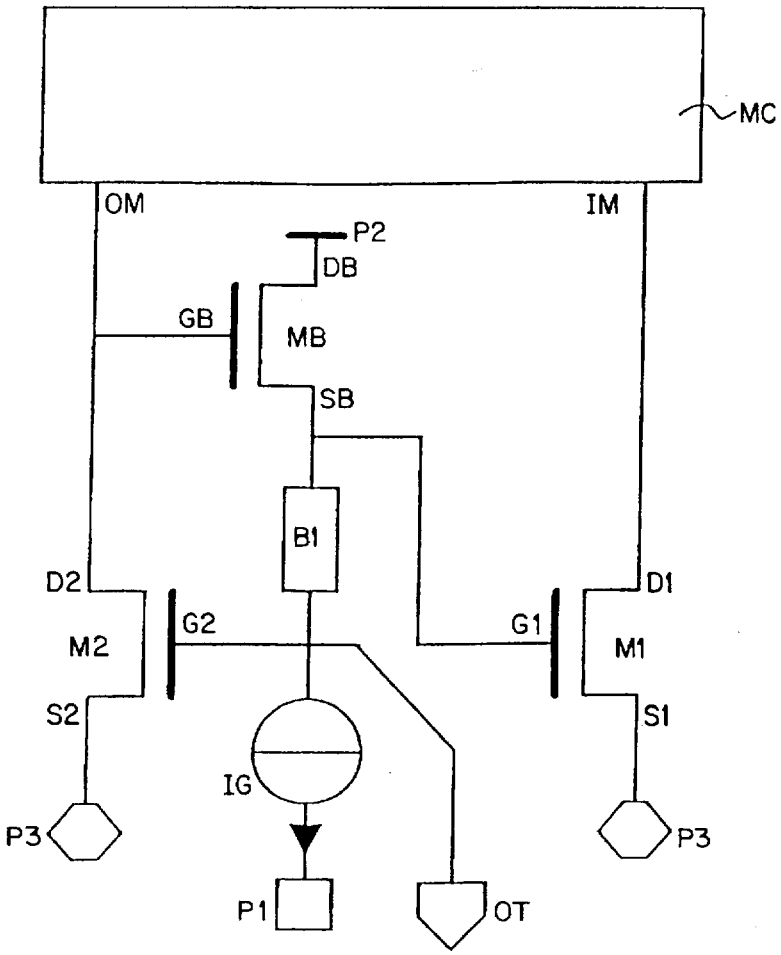
FIG. 4 shows a third circuit in accordance with another embodiment of the present invention.

FIG. 4 shows a variation of the circuit of FIG. 2 wherein the path FP of FIG. 2 consists of a transistor and a two-terminal circuit element B1 and the generator VG consists of the same two elements with the addition of a current generator. There are also shown three different potential references indicated by P1, P2, P3.

The terminals S1 and S2 are connected to the third reference potential P3 which can coincide in a particular case with the ground terminal GND. If this potential does not coincide with ground, a threshold subject to body effect will be extracted.

The circuit of FIG. 4 comprises an N-channel MOS bias transistor MB having a drain terminal DB connected to the second reference potential P2, e.g. the supply terminal VDD, a gate terminal GB connected to the terminal OM and a source terminal SB connected to the terminal G1. The circuit of FIG. 4 also comprises a two-terminal circuit element B1 connected between the terminals G1 and G2 and a current generator IG connected between the terminal G2 and the first reference voltage P1, e.g. the ground terminal GND.

Ignoring the gate current of the transistors M1 and M2, the generator IG causes a constant current to flow in the transistor MB which holds transistor MB in saturation and in the two-terminal circuit element B1 which involves a constant potential difference between the terminals G1 and G2. Since the transistor MB is held in saturation the potentials of the terminals G2 and D2 are mutually interlocked.

The two-terminal circuit element B1 can be provided by a resistor in a very simple manner or by diode-connected MOS transistors, by true diodes, etc.

This circuit may exhibit two operating points, if the voltage across the two-terminal circuit element B1 is lower than the threshold voltage. In these cases a start-up circuit is required to bias the circuit to the desired operating point after starting. This is a common practice in self-biasing circuits.

FIG. 5 shows a very advantageous variation of the circuit of FIG. 4 differentiated by the presence of a second two-terminal circuit element B2.

The second two-terminal circuit element B2 is substantially equal to the two-terminal circuit element B1 and is inserted between the terminal G2 and the generator IG. The output OT of the circuit is connected to the node connecting the second two-terminal circuit element B2 and the generator IG.

The generator IG causes the same current to flow both in the two-terminal circuit element B1 and the two-terminal circuit element B2 and, since these are substantially equal, a potential difference across each will be substantially equal. The output is thus at a potential equal to the threshold of the transistors M1 and M2. The detection of the threshold voltage using this circuit is extremely accurate because the effects of the two two-terminal circuit elements B1 and B2 compensate for each other. In an integrated embodiment the technological and geometrical equality is relatively easy to provide.

The circuit of FIG. 5 can also be described differently by stating that it comprises a voltage divider VD having an intermediate output E3, a first terminal E1 and a second terminal E2 and consisting of two essentially equal two-terminal circuit elements B1 and B2 and stating that the output E3 is connected to the terminal G2, the terminal E1 is connected to the terminal G1 and to the terminal SB, and the terminal E2 is connected to the generator IG and the output OT.

The two two-terminal circuit elements B1 and B2 can also be unequal. In this case however, it must be provided that:

$$\frac{\sqrt{A*K1/K2}}{1-\sqrt{A*K1/K2}}=\frac{Z1}{Z2}$$

where Z1 and Z2 are the impedances of the two two-terminal circuit elements B1 and B2.

Figure 6:
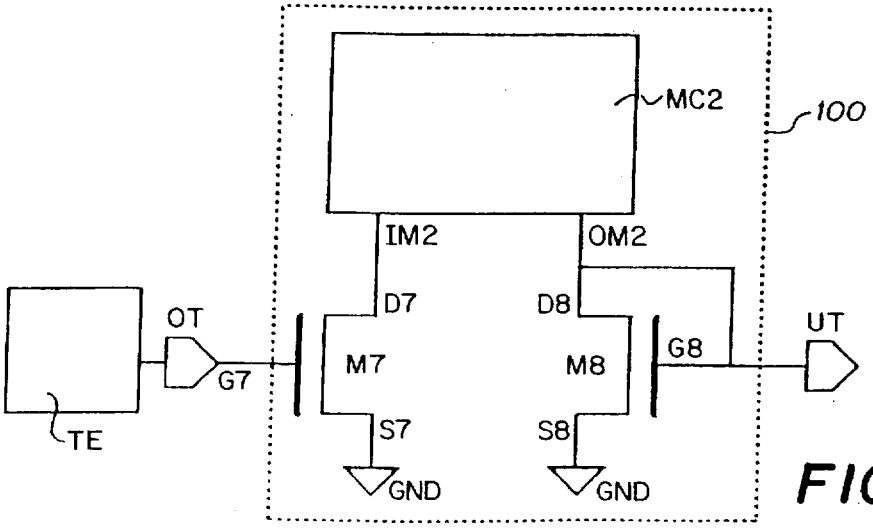
FIG. 6 shows a fifth circuit in accordance with another embodiment of the present invention.

FIG. 6 shows a circuit in accordance with another embodiment of the present invention. The circuit of FIG. 6 consists of a threshold extractor circuit TE like one of those described above or even that of the known art shown in FIG. 1 and of a stage 100 having an input connected to the output OT and having an output UT of its own. This stage is identical to the extractor circuit of the known art shown in FIG. 1.

The stage 100 comprises two N-channel MOS transistors M7 and M8 having the same threshold voltage as that of the transistors M1 and M2 and another current mirror MC2 having an input terminal IM2 and an output terminal OM2. The stage 100 has an input connected to the output OT of circuit TE and an output UT of its own. Source terminals S7 and S8 of transistors M7 and M8 are connected to the ground terminal GND, drain terminals D7 and D8 are respectively connected to the terminals IM2 and OM2, and gate terminals G7 and G8 are connected respectively to the input OT and the output UT. In addition the gate and drain terminals of the transistor M8 are connected together.

If the circuit of FIG. 2 is used as the extractor circuit TE in FIG. 6, by choosing the gain of the mirror MC2 approximately unitary and indicating by K7 and K8 the ratio W/L of transistors M7 and M8, the potential at the output UT is given by the sum of the threshold voltage (only one threshold voltage for the four transistors) and the voltage of the generator VG multiplied by a new constant having the value:

$$\frac{\sqrt{A*K2/K1}}{1-\sqrt{A*K2/K1}}=\sqrt{\frac{K7}{K8}}$$

This new constant depends only on geometric parameters and can thus be controlled and made either much greater or much smaller than the old constant depending on requirements.

Naturally one could connect one or more of such stages in cascade depending on the value of the desired constant.

In the foregoing description reference is made to direct connections between the various circuit elements but it should be clear to those skilled in the art that indirect connections, i.e. intermediated by other circuit elements could be used with no effect on the operation of the related circuits.

The above described circuits serve to extract the threshold of N-channel MOS transistors. If it were necessary to extract the threshold of P-channel transistors it would be necessary to use dual circuits. Some examples of said duality are that the ground terminals GND must be replaced by supply terminals VDD, the supply terminals VDD by ground terminals GND, the N-channel transistors by P-channel transistors, the P-channel transistors by N-channel transistors, etc. The circuit of FIG. 3 is e.g. the dual (in the above sense) of the circuit of FIG. 2.

It is also possible to use, instead of MOS transistors, other types of transistors, e.g. BJTs. In this case, however, the threshold concept is less accurate and could correspond to a voltage established between a base and an emitter of the BJT.

Figure 1:
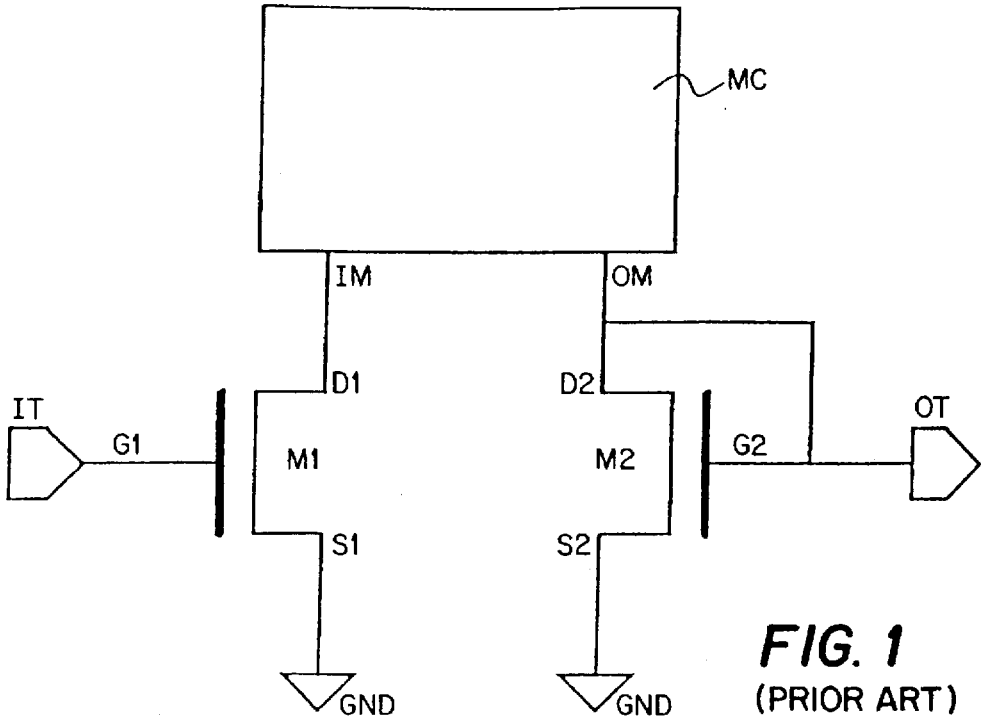
FIG. 1 (PRIOR ART)
FIG. 1 shows a circuit in accordance with the prior art.

Embodiments of the present invention also include a method of using a circuit of the type shown in FIG. 1 and in the use of a voltage generator connected between the gate terminals of the transistors M1 and M2 (and not to ground).

In accordance with another aspect of the present invention, there is created a closed feedback loop (instead of open) having gain less than one for stability.

Lastly, as mentioned above, the present invention finds advantageous application in a system that operates independent of temperature and/or dispersion of process parameters.

Such a system includes an operating circuit block, at least one threshold extraction circuit in accordance with one of the embodiments described above and having an output, and at least one bias network having an input coupled to said output and having an output coupled to said operating circuit block to supply bias currents and/or voltages.

The purpose of such a bias network is to generate a bias current or voltage linked to the threshold of a reference element. Assuming that the threshold has a value which depends on a physical parameter and assuming that operation of the circuit block also has an analogous dependence on the same parameter, by acting on the bias currents and/or voltages applied to the circuit block in relation to the value of said threshold it is possible to compensate for variations of the parameter (in time or from device to device) to achieve constant block operation.

These types of bias networks are well known in the literature and in any case within the ability of the average technician. An example of a voltage supply circuit is found in the article of M. Sasaki and F. Ueno, "A Novel Implementation of Fuzzy Logic Controller Using New Meet Operation", in Proceedings of the THIRD IEEE INTERNATIONAL CONFERENCE ON FUZZY SYSTEMS, Vol. III, pages 1676–1681, 26–29 June 1994.

Having thus described at least one illustrative embodiment of the invention, various alterations, modifications and improvements will readily occur to those skilled in the art. Such alterations, modifications, and improvements are intended to be within the spirit and the scope of the invention. Accordingly, the foregoing description is by way of example only and is not intended as limiting. The invention is limited only as defined in the following claims and the equivalents thereto.

What is claimed is:

1. A method of determining a threshold voltage of a transistor using a current mirror circuit having at least two input-output terminals, and using at least two transistors of the same type each having a control terminal and each having substantially a same threshold voltage to be determined by the method, said current mirror circuit supplying bias currents to the two transistors through said two input-output terminals, the method comprising steps of:

providing a potential difference between said two control terminals of the at least two transistors;

establishing a feedback path between said control terminals and one of said input-output terminals of the current mirror circuit so that the same threshold voltage of the at least two transistors is related to the potential of one of said control terminals;

detecting a value of the potential of the one of said control terminals; and determining the threshold voltage using the potential of the one of said control terminals.

2. The method of claim 1, wherein the step of establishing a feedback path includes establishing a closed feedback loop having a gain of less than one.

3. The method of claim 1, wherein the step of providing sets a potential of the control terminals of each of the two transistors to two different control voltages.

4. A transistor threshold voltage extraction circuit having an output, comprising:

at least two transistors of the same type having substantially a same threshold voltage level, each of the transistors having a control terminal, a first main conduction terminal and a second main conduction terminal;

a current mirror circuit having an input terminal and an output terminal coupled respectively to said two transistors to supply bias currents to the two transistors;

a voltage generator connected between said two control terminals, said voltage generator including a two-terminal circuit element and a bias network to provide a constant predetermined current through the two-terminal circuit element;

a feedback path between said control terminals and one of said input and output terminals of the current mirror circuit; and wherein said output of the voltage extraction circuit is coupled to one of said control terminals.

5. The transistor threshold voltage extraction circuit of claim 4, wherein the at least two transistors are MOS transistors constructed and arranged to operate in a saturation condition.

6. The transistor threshold voltage extraction circuit of claim 4, wherein the first main conduction terminals of the at least two transistors are each connected to a reference potential, the second main conduction terminal of a first of said two transistors is connected to the input terminal of said mirror circuit, and the second main conduction terminal and the control terminal of a second of the at least two transistors are connected together and to the output terminal of said mirror circuit and wherein the voltage generator is connected such that a potential of the control terminal of said second transistor is less than a potential of the control terminal of said first transistor.

7. The transistor threshold voltage extraction circuit of claim 6, wherein said two-terminal circuit element is connected between said two control terminals and wherein said bias network includes a current generator connected between the control terminal of a first transistor of said two transistors and a first reference potential and a bias transistor having a control terminal coupled to the output terminal of the mirror circuit and a main conduction path connected between the control terminal of a second transistor of said two transistors and a second reference potential.

8. The transistor threshold voltage extraction circuit of claim 4, wherein the two-terminal circuit element includes at least one resistor.

9. The transistor threshold voltage extraction circuit of claim 4, further comprising:

at least third and fourth transistors of the same type each having a control terminal and a threshold voltage substantially equal to the threshold voltage of the at least two transistors, the control terminal of said third transistor being coupled to said control terminals of said at least two transistors;

a second current mirror circuit having at least one input terminal and one output terminal, said input terminal and said output terminal being coupled respectively to said third and fourth transistors to provide bias currents; and wherein said output is coupled to the connection of the control terminal of said fourth transistor and of the output terminal of said mirror circuit.

10. A transistor threshold voltage extraction circuit having an output, comprising:

at least two transistors of the same type having substantially a same threshold voltage level, each of the transistors having a control terminal, a first main conduction terminal and a second main conduction terminal;

a current mirror circuit having an input terminal and an output terminal coupled respectively to said two transistors to supply bias currents to the two transistors;

a voltage generator connected between said two control terminals;

a feedback path between said control terminals and one of said input and output terminals of the current mirror circuit;

a voltage divider having an intermediate output and first and second end terminals, the voltage divider including two-terminal circuit elements and wherein said first main conduction terminals are coupled to a third reference potential, the second main conduction terminal of a first transistor of said two transistors is coupled to the input terminal of said mirror circuit, the second main conduction terminal of a second transistor of said two transistors is coupled to the output terminal of said mirror circuit, the control terminal of said second transistor is coupled to said intermediate output and the control terminal of said first transistor is coupled to said first end terminal, said first end terminal is coupled to a second reference potential for bias of said divider and in which said output is coupled to said second end terminal; and wherein said output of the voltage extraction circuit is coupled to one of said control terminals.

11. The transistor threshold voltage extraction circuit of claim 10, further comprising a current generator connected between said second end terminal and a first reference potential and a bias transistor having its control terminal coupled to said output terminal of the current mirror circuit and a main conduction path respectively connected between said first end terminal and said second reference potential.

12. The transistor threshold voltage extraction circuit of claim 10, wherein the two-terminal circuit elements include at least one resistor.

13. A circuit comprising:

an operating circuit block;

a transistor threshold voltage extraction circuit having an output, including:

at least two transistors of the same type having substantially a same threshold voltage level, each of the transistors having a control terminal, a first main conduction terminal and a second main conduction terminal;

a current mirror circuit having an input terminal and an output terminal coupled respectively to said two transistors to supply bias currents to the two transistors;

a voltage generator connected between said two control terminals, said voltage generator including a two-terminal circuit element and a bias network to provide a constant predetermined current through the two-terminal circuit element;

a feedback path between said control terminals and one of said input and output terminals of the current mirror circuit; and wherein said output of the voltage extraction circuit is coupled to one of said control terminals; and at least one bias network having an input connected to said output and having an output connected to said operating circuit block to bias the circuit block.

14. The circuit of claim 13, wherein in the threshold voltage extraction circuit the first main conduction terminals of the at least two transistors are each connected to a reference potential, the second main conduction terminal of a first of said two transistors is connected to the input terminal of said mirror circuit, and the second main conduction terminal and the control terminal of a second of the at least two transistors are connected together and to the output terminal of said mirror circuit and wherein the voltage generator is connected such that a potential of the control terminal of said second transistor is less than a potential of the control terminal of said first transistor.

15. The circuit of claim 14, wherein in the threshold voltage extraction circuit said two-terminal circuit element is connected between said two control terminals and wherein said bias network includes a current generator connected between the control terminal of a first transistor of said two transistors and a first reference potential and a bias transistor having a control terminal coupled to the output terminal of the mirror circuit and a main conduction path connected between the control terminal of a second transistor of said two transistors and a second reference potential.

16. A circuit comprising:

an operating circuit block;

a transistor threshold voltage extraction circuit having an output, including:

at least two transistors of the same type having substantially a same threshold voltage level, each of the transistors having a control terminal, a first main conduction terminal and a second main conduction terminal;

a current mirror circuit having an input terminal and an output terminal coupled respectively to said two transistors to supply bias currents to the two transistors;

a voltage generator connected between said two control terminals, said voltage generator including a voltage divider having an intermediate output and first and second end terminals, the voltage divider including two-terminal circuit elements and wherein said first main conduction terminals are coupled to a third reference potential, the second main conduction terminal of a first transistor of said two transistors is coupled to the input terminal of said mirror circuit, the second main conduction terminal of a second transistor of said two transistors is coupled to the output terminal of said mirror circuit, the control terminal of said second transistor is coupled to said intermediate output and the control terminal of said first transistor is coupled to said first end terminal, said first end terminal is coupled to a second reference potential for bias of said divider and in which said output is coupled to said second end terminal;

a feedback path between said control terminals and one of said input and output terminals of the current mirror circuit; and wherein said output of the voltage extraction circuit is coupled to one of said control terminals; and at least one bias network having an input connected to said output and having an output connected to said operating circuit block to bias the circuit block.

17. The circuit of claim 16, wherein the threshold voltage extraction circuit further includes a current generator connected between said second end terminal and a first reference potential and a bias transistor having its control terminal coupled to said output terminal of the current mirror circuit and a main conduction path respectively connected between said first end terminal and said second reference potential.

18. A circuit comprising:

an operating circuit block;

a transistor threshold voltage extraction circuit having an output, including:

at least two transistors of the same type having substantially a same threshold voltage level, each of the transistors having a control terminal, a first main conduction terminal and a second main conduction terminal;

a current mirror circuit having an input terminal and an output terminal coupled respectively to said two transistors to supply bias currents to the two transistors;

a voltage generator connected between said two control terminals;

a feedback path between said control terminals and one of said input and output terminals of the current mirror circuit;

wherein said output of the voltage extraction circuit is coupled to one of said control terminals;

at least third and fourth transistors of the same type each having a control terminal and a threshold voltage substantially equal to the threshold voltage of the at least two transistors, the control terminal of said third transistor being coupled to said control terminals of said at least two transistors;

a second current mirror circuit having at least one input terminal and one output terminal, said input terminal and said output terminal being coupled respectively to said third and fourth transistors to provide bias currents; and wherein said output is coupled to the connection of the control terminal of said fourth transistor and of the output terminal of said mirror circuit; and at least one bias network having an input connected to said output and having an output connected to said operating circuit block to bias the circuit block.

19. A circuit for determining a threshold voltage of a transistor comprising:

a current mirror circuit having at least two input-output terminals;

at least two transistors each of the transistors having a control terminal and each having substantially a same threshold voltage, each of the transistors being coupled to one of the input-output terminals of the current mirror circuit to receive bias currents;

means for providing a potential difference between said two control terminals of the at least two transistors; and means for determining the same threshold voltage of each of the at least two transistors.

20. A circuit for extracting a threshold voltage of a MOS transistor, the circuit comprising:

a first voltage threshold extraction circuit having an input and an output, and having first and second transistors each having a threshold voltage substantially equal to the threshold voltage of the MOS transistor; and a second voltage threshold extraction circuit having an input coupled to the output of the first voltage threshold extraction circuit and having an output, the second voltage extraction circuit having third and fourth transistors each having a threshold voltage substantially equal to the threshold voltage of the MOS transistor.

21. The circuit of claim 20, wherein one of the first and second voltage extraction circuits includes:

a current mirror circuit having at least two input-output terminals;

at least two transistors each of the transistors having a control terminal and each having substantially a same threshold voltage, each of the transistors being coupled to one of the input-output terminals of the current mirror circuit to receive bias currents;

a voltage generation circuit coupled between said two control terminals of the at least two transistors; and a feedback path coupled between said control terminals and one of said input-output terminals of the current mirror circuit.

* * * * *